US005189926A

United States Patent [19]

Patterson et al.

[11] Patent Number: 5,189,926

[45] Date of Patent: Mar. 2, 1993

[54] THROTTLE CONTROL

[75] Inventors: Jon M. Patterson, Wauwatosa, Wis.; James H. Weitz, Ridgewood, N.J.

[73] Assignee: Deere & Company, Moline, Ill.

[21] Appl. No.: 715,532

[22] Filed: Jun. 14, 1991

[51] Int. Cl.[5] ..... G05G 5/06

[52] U.S. Cl. ..... 74/527; 74/533; 74/531; 74/475

[58] Field of Search ..... 74/527, 523, 502.2, 74/502.6, 531, 533, 526, 474, 473 R, 475

[56] References Cited

U.S. PATENT DOCUMENTS

| | | | |
|---|---|---|---|
| 3,086,407 | 4/1963 | Reece | 74/533 |
| 3,524,979 | 8/1970 | Cohen | 74/502.2 |
| 3,564,929 | 2/1971 | Halstead | 74/526 |
| 4,633,733 | 1/1987 | Tavener | 74/533 |
| 4,744,265 | 5/1988 | Nagano | 74/527 |
| 4,949,591 | 8/1990 | Roelle | 74/527 |

FOREIGN PATENT DOCUMENTS

| | | | |
|---|---|---|---|
| 3409144 | 8/1985 | Fed. Rep. of Germany | 74/523 |
| 0038199 | 2/1990 | Japan | 74/502.2 |
| 0147487 | 6/1990 | Japan | 74/502.2 |
| 2001919 | 2/1979 | United Kingdom | 74/502.2 |

*Primary Examiner*—David A. Scherbel
*Assistant Examiner*—Winnie Yip

[57] ABSTRACT

A pivotal throttle control lever having a plurality of primary flaps with teeth formed therein in an arc about the pivot axis of the lever. A plurality of ribs, each corresponding to a respective primary flap are provided for engaging the teeth as the lever is pivoted by the operator. The ribs deflect the primary flaps only as the teeth engage the ribs during pivotal shifting of the lever. The ribs are offset within respective spaces between the teeth such that the primary flaps alternate deflecting as the ribs encounter the teeth. A choke flap is formed integrally with the lever and deflects as a choke tooth abuts a first portion of the control quadrant. The choke tooth is positionable within an opening for securing the lever in the choke mode. The resistance to shifting created by the choke tooth in abutment with the first portion is great than the resistance created by the teeth encountering the ribs, such that the operator senses the position of the lever during shifting.

28 Claims, 2 Drawing Sheets

THROTTLE CONTROL

BACKGROUND OF THE INVENTION

1. Field of the Invention

The invention relates to control levers shiftable by an operator to adjust the throttle of a powered vehicle.

2. Description of the Related Art

Conventional powered implements or vehicles such as lawn tractors typically include a lever for controlling the throttle of the engine. A common throttle control provides a lever pivotally riveted to a rivet plate carried by the vehicle frame. A nylon washer or other mechanism is positioned on the rivet between the lever and the rivet plate. The friction between the nylon and the lever creates resistance, such that the lever is held in place at the selected throttle position. However, over periods of extensive use the nylon washer is subject to wear and may therefore loose its capability to securely hold the lever in place. The throttle return spring may eventually overcome the resistance offered by the worn nylon washer such that the lever will shift out of the selected position. Also, this type of conventional throttle control may make it difficult for the operator to sense how far he has adjusted the throttle lever, and therefore the lever offers no "feel" to the operator. Conventional throttle controls also have provided a choke feature that requires the operator to pivot or shift the lever axially with respect to the rivet such that the lever may become fatigued and bend after many uses.

Therefore it would be desirable to provide a throttle control mechanism that allows the operator to feel or sense how much he is adjusting the throttle. It would also be desirable to provide a throttle control that resists wearing over time, and that therefore remains in the position selected by the operator even after extensive use. It would be desirable to provide a choke feature that is simple to operate and that will not over-stress or break the lever mechanism. It would also be desirable to provide such a throttle lever mechanism that is simple in construction, and having relatively few parts such that the mechanism can be manufactured and assembled at a relatively low cost.

SUMMARY OF THE INVENTION

The preferred embodiment of the present invention provides a pivotal throttle control lever formed of a plastic material and having a plurality of deflectable pie-shaped primary flaps. A series of teeth formed in the primary flaps are arranged in an arc about the pivot axis of the lever. A plurality of ribs, each corresponding to a respective primary flap, are provided for engaging the teeth as the lever is pivoted by the operator. The abutment of the ribs against the teeth blocks the lever from pivoting during operation. The ribs act to deflect the primary flaps during pivotal shifting of the lever to allow the teeth to "click" across the ribs. The primary flaps are undeflected when the lever is not being shifted by the operator. Stress in the material of the primary flaps is thereby decreased. The ribs are offset within respective spaces between the teeth such that the primary flaps alternate deflecting as the ribs encounter the teeth during pivoting. The stress experienced per click by the primary flaps is thereby further reduced, since each primary flap does not deflect for every "click" the operator experiences. The amount of wear encountered by the ribs each time the operator experiences a click is reduced, since each rib abuts against a tooth only once every two clicks. A choke flap and choke tooth are formed integrally with the lever and deflect as the choke tooth abuts a first portion of the control quadrant. The choke tooth is positionable within an opening for securing the lever in the choke mode. The resistance to shifting created by the abutment of the choke tooth against the first portion is greater than the resistance created by the abutment of the teeth against the ribs, such that the operator can sense the position of the lever during shifting.

Figure 2:
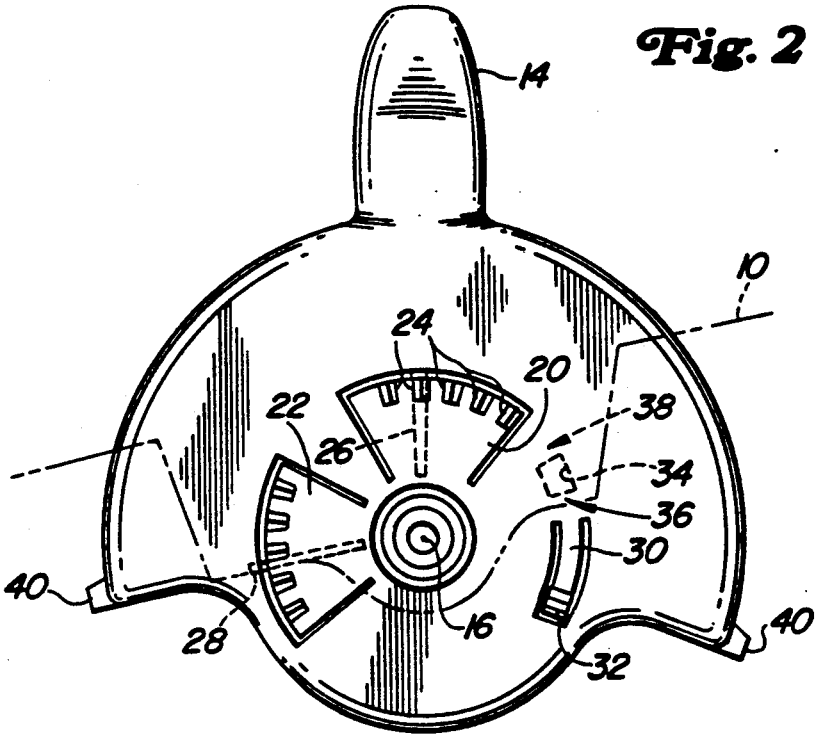
FIG. 2 is a view of the left side of the throttle control lever pivotally coupled with the vehicle control panel.

FIGS. *3a*, *3b* and *3c* are linear representations of the interaction of the teeth with the ribs, and are taken along a line that extends in an arc about the lever's pivot point and through the teeth of the flaps as seen in FIG. 2. FIG. *3a* shows the lever in a position whereat a tooth of the first flap is in abutment with the first rib.

FIG. *3b* shows the lever in a position whereat the tooth of the first flap has shifted across the first rib from the position shown in FIG. *3a*. The second rib is shown within the space formed by adjacent teeth of the second flap.

FIG. *3c* shows the lever in the choke position and having the choke tooth of the choke flap received by the opening.

DESCRIPTION OF THE PREFERRED EMBODIMENT

Figure 1:
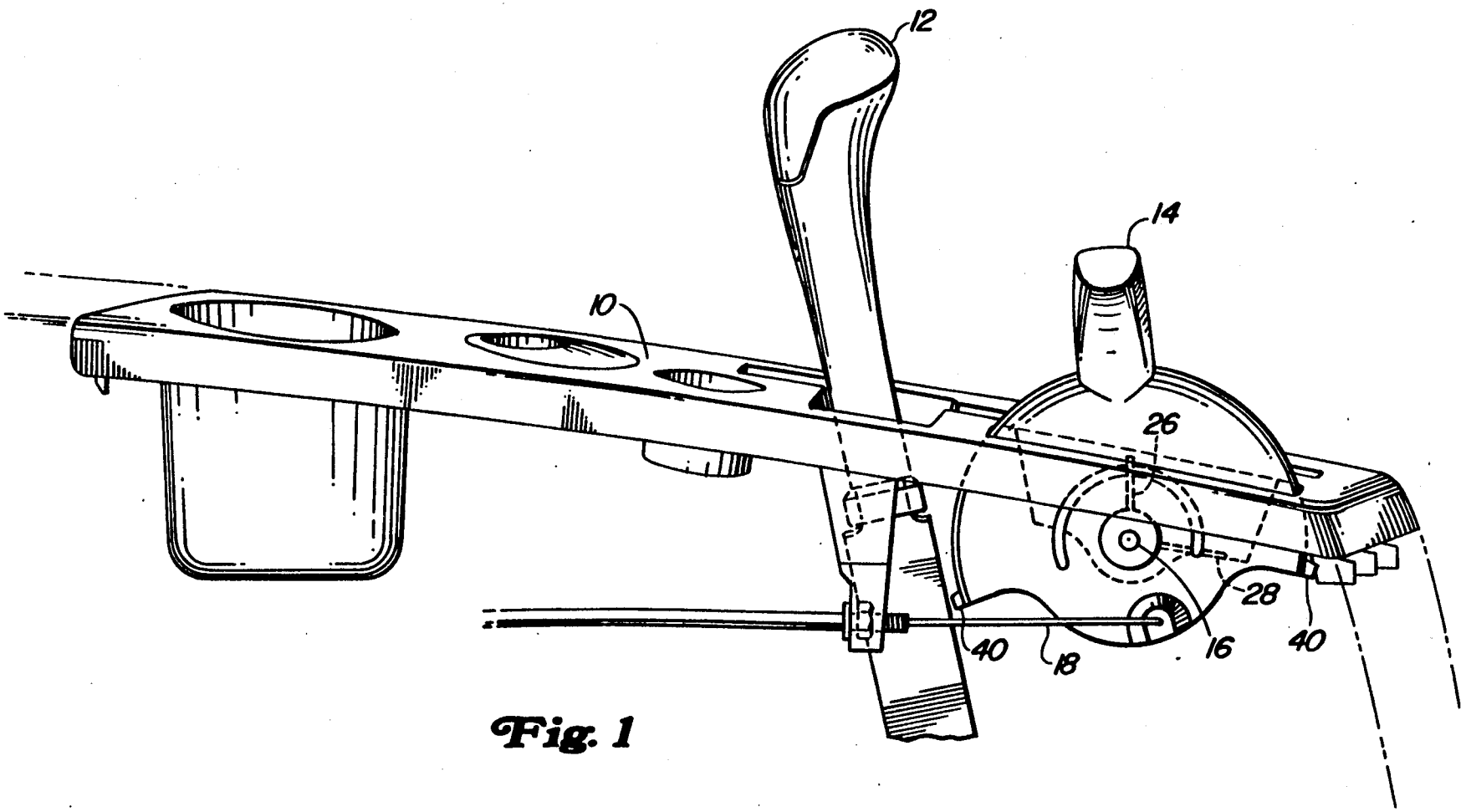
FIG. 1 is a view of the right side of a vehicle control panel or quadrant.

Referring now to FIG. 1 there is shown a control panel or quadrant 10 as used with a riding lawn vehicle. The panel 10 according to the preferred embodiment is positioned to the right of the vehicle seat, and provides controls such as a shift lever 12 and a throttle control lever 14. The throttle lever 14 is formed of a plastic material and is coupled to the vehicle via a pivotal coupling 16. A cable 18 is coupled with the throttle lever 14 and extends rearwardly to an engine for controlling the throttle. The operator pivots the throttle lever 14 about its axis or coupling 16 to thereby adjust the throttle.

Referring now to FIG. 2, there is shown the throttle lever 14 coupled with the panel 10 as viewed from the left side of the vehicle. The preferred embodiment provides a pair of deflectable primary flaps 20 and 22 formed integrally with the lever 14 and arranged in an arc about the pivotal coupling 16. The primary flaps 20 and 22 include a plurality of teeth 24 spaced in an arc about the lever's pivot axis 16 and upstanding from the surface of the primary flaps 20 and 22. A pair of rib members 26 and 28 are defined by the quadrant 10, and each correspond to a respective primary flap 20 or 22. The ribs 26 and 28 are abuttable with the teeth 24 of respective primary flaps 20 and 22 for blocking the lever 14 from pivoting when not being shifted by the operator. When the lever 14 is shifted by the operator, the ribs 26 and 28 abut the teeth 24 of the primary flaps 20 and 22 and thereby act to deflect the primary flaps 20 and 22 to allow the teeth 24 to shift past the ribs 26 and 28.

As the teeth 24 shift past the ribs 26 and 28, the resilient plastic material of the deflectable latch flaps 20 and 22 acts to spring or bias the flaps 20 and 22 back toward the ribs 26 and 28. The material of the primary flaps 20 and 22 therefore provides a spring or biasing mechanism that maintains the teeth 24 in abutting relation with the ribs 26 and 28. Since the resilient material of the primary flaps 20 and 22 biases the teeth 24 into abutting relation with the ribs 26 and 28, the need for a separate biasing mechanism such as a spring is eliminated, and the number of separate parts required is reduced.

Figure 3A:
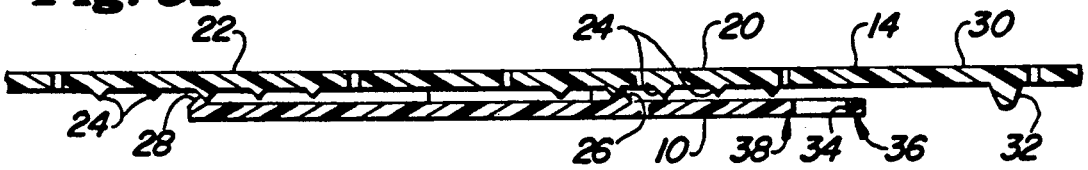
Figure 3B:
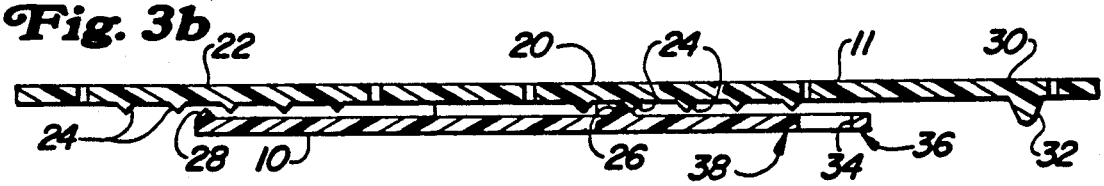
Figure 3C:
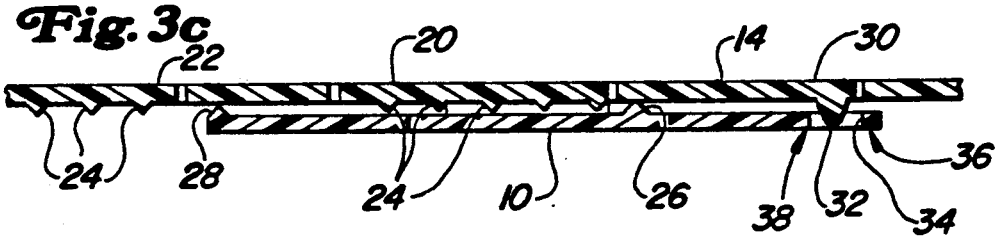

A choke feature is also provided by the preferred embodiment. A deflectable choke flap 30, as seen in FIG. 2, is formed integral with the throttle lever 14 and includes a choke tooth 32 upstanding from the surface of the choke flap 30. An opening 34 is defined between first and second portions 36 and 38 of the quadrant 10 for receiving the choke tooth 32 when the operator shifts the lever 14 to the choke position. As the operator pivots the lever 14 to the choke position, the choke tooth 32 abuts the first portion 36 and thereby deflects the choke flap 30 to allow the choke tooth 32 to shift past the first portion 36. The lever 14 is securely blocked from shifting from the choke mode when the choke tooth 32 is positioned within the opening 34, as best seen in FIG. 3c.

A pair of abutment members 40 are formed integral with the throttle lever 14 for abutting the underside of the quadrant 10 to define the lever's limits of pivotal travel.

The throttle lever 14 according to the preferred embodiment of the present invention is formed from a plastic material. The plastic material of the primary flaps 20 and 22 experience stress as they deflect to allow the lever 14 to be pivoted by the operator. To minimize the stress encountered by the plastic material, the mechanism is formed such that the flaps 20 and 22 are deflected only when the teeth 24 abut the ribs 26 and 28 as the lever 14 pivots. Therefore, when the lever 14 is not being shifted, the flaps 20 and 22 are undeflected. For example, when positioned in the space between the teeth 24 of the primary flaps 20 and 22, the peaks of the ribs 26 and 28 are positioned adjacent to, but not in contact with, the surface of the primary flaps 20 and 22. Therefore the flaps 20 and 22 remain undeflected when the ribs 26 and 28 are positioned within the spaces between the teeth 24. However, the space between the peaks of the ribs 26 and 28 and the surfaces of the primary flaps 20 and 22 is less than the height of the teeth 24, as seen in FIG. 3, such that the ribs 26 and 28 and teeth 24 will contact or interfere with each other as the lever 14 pivots. Therefore, as the teeth 24 abut a rib 26 or 28, the primary flap 20 or 22 will deflect to allow the tooth 24 to pass across the rib 26 or 28 when the operator shifts the lever 14. The flaps 20 and 22 deflect only when the operator pivots the lever 14, and are undeflected when the lever 14 is stationary during normal operation of the vehicle. Since the flaps 20 and 22 deflect relatively infrequently, the plastic material is subjected to a relatively small amount of stress. The working life of the mechanism is thereby increased.

The stress encountered by the plastic material of the primary flaps 20 and 22 is also reduced by the spacing or configuration of the ribs 26 and 28 according to the preferred embodiment. Each rib 26 and 28 of the preferred embodiment corresponds to a respective primary flap 20 and 22. When the lever 14 is not being shifted by the operator, both ribs 26 and 28 are positioned in respective uniform spaces formed between pairs of teeth 24. However, the ribs 26 and 28 are not located in the same relative position within the respective spaces. The ribs 26 and 28 are offset by approximately half the length of the space between the teeth 24. When the ribs 26 and 28 are configured in this manner, they each encounter respective teeth 24 at different pivotal positions of the lever 4, and at different points in time as the operator shifts the lever 14. The primary flaps 20 and 22 thereby alternate deflecting. In other words, when the operator shifts the lever 14 through a range of motion, the first rib 26 encounters a tooth 24 of the first primary flap 20, as seen in FIG. 3a, while the second rib 28 is positioned within the space between a pair of teeth 24 of the second primary flap 22. Once the tooth 24 of the first primary flap 20 is shifted past the first rib 26, as seen in FIG. 3b, both ribs 26 and 28 are positioned in respective spaces between pairs of teeth 24. If the lever 14 continues to pivot, the second rib 28 will encounter a tooth 24 while the first rib 26 is positioned in a space between two teeth 24. The primary flaps 20 and 22 thereby alternate deflecting as the ribs 26 and 28 encounter respective teeth 24. The present invention allows the operator to sense or feel the clicking of the teeth 24 passing across the ribs 26 and 28. However, since the ribs 26 and 28 are offset, the primary flaps 20 and 22 alternate deflecting such that each primary flap 20 and 22 deflects only once for every two "clicks" according to the preferred embodiment. By reducing the number of times each primary flap 20 and 22 deflects for each click, the stress encountered by the material of the primary flaps 20 and 22 per click sensed by the operator is correspondingly reduced.

Furthermore, the offset configuration of the ribs 26 and 28 according to the preferred embodiment helps reduce wearing of the ribs 26 and 28 for each click experienced by the operator. The ribs 26 and 28 are subjected to wear when they contact and rub against the teeth 24 of the primary flaps 20 and 22. However, the ribs 26 and 28 are offset within respective spaces formed between the teeth 24. The ribs 26 and 28 therefore alternate engaging respective teeth 24 as the lever 14 pivots. Since each rib 26 and 28 abuts a tooth 24 only once for every two "clicks" experienced by the operator, the amount of rib wear per click is reduced. The ribs 26 and 28 arranged according to the preferred embodiment are subjected to approximately half the wear per click than would be produced if all the ribs 26 and 28 were positioned to engage respective teeth 24 at the same pivotal position of the lever 14.

The preferred embodiment provides a pair of primary flaps 20 and 22 and two ribs 26 and 28 offset approximately a half space between the teeth 24. However, more than two primary flaps could be provided. If more than two primary flaps are provided, and the number of primary flaps provided equals N, then N ribs should be offset approximately 1/N of a space between respective teeth. The stress in the primary flap material is thereby reduced by reducing the number of times each flap is deflected per click. Similarly, each offset rib will be subjected to 1/N of the wear per click encountered by ribs that are not offset. The ribs could be offset a distance other than 1/N, but the operator would then sense the clicks at irregular intervals, and may not accurately sense how far he has shifted the lever. Also, more than one rib could be provided corresponding to each primary flap.

The choke flap 30 according to the preferred embodiment is in an undeflected position during most of the lever's pivotal range of motion. The choke flap 30 will deflect as the choke tooth 32 encounters the first portion 36 of the quadrant 10 to allow the choke tooth 32 to be received by the opening 34. When positioned within the opening 34, the choke flap 30 is again undeflected. Therefore, the choke flap material encounters stress only when the choke tooth 32 engages the first portion 36. Since the choke flap 30 encounters stress only infrequently, the possibility of the choke flap 30 becoming fatigued or failing is reduced.

The choke tooth 32 is larger than the teeth 24 formed in the primary flaps 20 and 22, and interferes with the first portion 36 more than the teeth 24 interfere with the ribs 26 and 28. The choke tooth 32 therefore offers a relatively large resistance to being shifted past the first portion 36 and into the opening 34. The operator senses this greater resistance to shifting, and is thereby informed of the position of the lever 14. Therefore, the operator can sense when the lever 14 is shifting into and out of the choke position.

I claim:

1. A control usable with a vehicle such as a lawn and garden tractor, comprising:

a lever pivotally carried by the vehicle and selectively engagable by the operator for pivoting about an axis to control a mechanism such as the throttle of the vehicle, said lever including a deflectable primary flap having a surface, said primary flap being in a substantially undeflected position with the lever is not being shifted by the operator, the material of the primary flap serving to bias the flap toward the undeflected position, a plurality of teeth radially spaced about the lever's pivot axis and each having a projecting height from the surface of the primary flap, a rib member rigidly carried by the vehicle and abuttable with the teeth of the primary flap for blocking the lever from pivoting when not being shifted by the operator, said rib member being abuttable with the teeth of the primary flap to deflect the primary flap in a direction generally parallel to said axis of the lever for allowing the teeth to shift past the rib when the operator pivots the lever, said rib member being positioned a distance from the surface of the primary flap for allowing the primary flap to remain undeflected when the lever is not being pivoted.

2. The invention of claim 1, wherein the rib member includes a peak positioned a distance from the surface of the primary flap, such that said primary flap is undeflected when the operator is not pivoting the lever, said distance between the rib peak and the surface of the primary flap being smaller than the height of the teeth, such that said teeth and rib are abuttable to deflect the primary flap as the operator pivots the lever.

3. The invention of claim 2, wherein the primary flap is formed integral with the lever.

4. The invention of claim 1, wherein the primary flap is generally pie-shaped.

5. The invention of claim 1 wherein the lever and primary flap formed integral therewith are formed of a generally resilient plastic material.

6. The invention of claim 1, and further including a choke flap formed integrally with the lever and spaced from the primary flap, a choke tooth formed upstanding from the surface of the choke flap, and first and second portions defined by the frame, and spaced in an arc from the rib, an opening being defined between the first and second portions for receiving the choke tooth when the throttle is in a choke mode, said choke tooth being abuttable with the first portion for deflecting the choke flap when the operator pivots the lever to a choke position, said choke flap being undeflected when positioned within the space defined between the first and second portions, and undeflected when the lever is in an unchoked mode.

7. The invention of claim 6 wherein the choke tooth interferes with the first portion to a greater extent than the primary flap teeth interfere with the rib member.

8. The invention of claim 7 wherein the lever, primary flap and choke formed integral therewith are formed of a generally resilient plastic material.

9. The invention of claim 1, wherein the primary flap deflects with respect to the lever for allowing the lever to be pivoted in first and second opposite directions about its axis without requiring the lever to be shifted in directions perpendicular to the first and second directions.

10. The invention of claim 1, wherein the primary flap is formed integral with the lever.

11. A control usable with a powered vehicle, comprising:

a lever pivotally carried by the vehicle and selectively engagable by the operator for pivoting about an axis to control a vehicle, said lever including a plurality of deflectable primary flaps each having a surface, the number of primary flaps equaling N, each of said primary flaps being in a substantially undeflected position when the lever is not being shifted by the operator, a plurality of teeth positioned radially about the lever's pivot axis a projecting from the surface of each primary flap, a generally uniform space being defined between each two adjacent teeth, and a plurality of rib members at least equal in number to the number of primary flaps, each of said rib members being carried by the vehicle and abuttable with the teeth of the respective primary flaps for blocking the lever from pivoting when not being shifted by the operator, said rib members being abuttable with the teeth of respective primary flaps to deflect the respective primary flaps in a direction generally parallel to said axis of the lever for allowing the ribs and teeth to shift past each other when the operator pivots the lever, said ribs being offset within respective uniform spaces between the teeth by approximately 1/N of the uniform space such that each rib encounters a respective tooth at a different pivotal position of the lever as the lever pivots the length of a uniform space.

12. The invention of claim 11, wherein N equals 2.

13. The invention of claim 11, wherein each rib member includes a peak positioned adjacent a respective primary flap and is positioned a distance from the surface of the respective primary flap, said primary flaps are undeflected when the operator is not pivoting the lever, and said distance between the rib peaks and respective surfaces of the primary flaps are smaller than the height of the teeth, such that said teeth and ribs are abuttable to deflect the primary flap as the operator pivots the lever.

14. The invention of claim 13, wherein N equals 2.

15. The invention of claim 13, wherein the primary flap is formed integral with the lever.

16. The invention of claim 11, wherein the primary flaps are each generally pie-shaped.

17. The invention of claim 11, wherein the lever and primary flaps integral therewith are formed of a generally resilient plastic material.

18. The invention of claim 17, wherein N equals 2.

19. The invention of claim 11, and further including a choke flap formed integral with the lever and radially offset from the primary flaps, a choke tooth formed upstanding from the surface of the choke flap, first and second portions defined by the frame, and spaced in an arc from the ribs, an opening being defined between the first and second portions for receiving the choke tooth when the lever is in a choke position, said choke tooth being abuttable with the first portion for deflecting the choke flap when the operator pivots the lever to a choke position, said choke flap being undeflected when not being deflected by the first portion, and undeflected when positioned within the opening defined between the first and second portions.

20. The invention of claim 19, wherein N equals 2.

21. The invention of claim 19, wherein the choke tooth interferes with the first portion to a greater extent than the teeth carried by the primary flaps interfere with the rib members.

22. The invention of claim 21, wherein the lever and primary flaps integral therewith are formed of a generally resilient plastic material.

23. The invention of claim 22, wherein N equals 2.

24. The invention of claim 11, wherein the material of the primary flaps acts to bias the flaps toward the undeflected position.

25. The invention of claim 24, wherein the primary flap deflects with respect to the lever for allowing the lever to be pivoted in first and second opposite directions about its axis without requiring the lever to be shifted in directions perpendicular to the first and second directions.

26. The invention of claim 11, wherein said rib members are positioned a distance from the respective surfaces of the primary flaps for allowing the primary flaps to remain undeflected when the lever is not being pivoted.

27. The invention of claim 11, wherein the primary flap deflects with respect to the lever for allowing the lever to be pivoted in first and second opposite directions about its axis without requiring the lever to be shifted in directions perpendicular to the first and second directions.

28. The invention of claim 11, wherein the primary flap is formed integral with the lever.

* * * * *

UNITED STATES PATENT AND TRADEMARK OFFICE

CERTIFICATE OF CORRECTION

PATENT NO. : 5,189,926

DATED : March 2, 1993

INVENTOR(S) : Jon M. Patterson et al.

It is certified that error appears in the above-identified patent and that said Letters Patent is hereby corrected as shown below:

Column 5, line 27, delete "with" and insert therefore --when--.

Column 5, line 61, delete "generally resilient".

Column 6, line 7, delete "space" and insert therefore --opening--.

Column 6, line 14, before "formed" insert --flap--.

Column 6, line 15, delete "generally resilient".

Column 7, lines 5 and 6, delete "generally resilient".

Column 8, lines 5 and 6, delete "generally resilient".

Signed and Sealed this

Fifteenth Day of February, 1994

*Attest:*

*Attesting Officer*

Bruce Lehman

BRUCE LEHMAN

*Commissioner of Patents and Trademarks*